United States Patent [19]

Karl et al.

[11] 4,310,937

[45] Jan. 19, 1982

[54] MOORING TERMINAL WITH TOP MOUNTED FLUID SWIVEL

[75] Inventors: Robert D. Karl, Pacific Palisades; James M. Kentosh; John Vitale, both of Los Angeles, all of Calif.

[73] Assignee: Amtel, Inc., Providence, R.I.

[21] Appl. No.: 71,272

[22] Filed: Aug. 30, 1979

[51] Int. Cl.[3] ..... B63B 21/52

[52] U.S. Cl. ..... 9/8 P

[58] Field of Search ..... 9/8 P, 8.3 R; 114/230; 141/387, 388; 137/236, 615; 285/134

[56] References Cited

U.S. PATENT DOCUMENTS

| | | | |
|---|---|---|---|
| 3,074,082 | 1/1963 | Griebe | 9/8 P |
| 3,082,440 | 3/1963 | Rhedin | 9/8 P |
| 3,366,982 | 2/1968 | Sutton | 9/8 P |
| 3,619,832 | 11/1971 | Westra | 9/8 P |
| 3,641,602 | 2/1972 | Flory et al. | 9/8 P |
| 3,666,395 | 5/1972 | Kubasta | 9/8.3 R |
| 3,735,435 | 5/1973 | Mikulicic et al. | 9/8 P |
| 3,894,567 | 7/1975 | Mott et al. | 9/8 P |

FOREIGN PATENT DOCUMENTS

| | | | |
|---|---|---|---|
| 2131200 | 1/1972 | Fed. Rep. of Germany | 9/8 P |

*Primary Examiner*—Trygve M. Blix
*Assistant Examiner*—Jesús D. Sotelo
*Attorney, Agent, or Firm*—Freilich, Hornbaker, Wasserman, Rosen & Fernandez

[57] ABSTRACT

A mooring and cargo transfer terminal is described, of the type which includes a buoy held at a predetermined height above the seabed as by a single anchor leg, to moor a ship which can drift in rotation about the buoy while a floating hose structure carries fluid to or from the ship, wherein the terminal is constructed to protect the buoy end of the floating hose structure from wave action, while facilitating maintenance of the fluid swivel which connects a nonrotating conduit extending up from the seabed to a rotating conduit connected to the floating hose structure. The fluid swivel is mounted at the top of the buoy for easy maintenance, and a rotating pipe connected to the rotating portion of the swivel extends therefrom and downwardly to an underwater depth below the troughs of waves, so that the buoy end of the floating hose structure is always below the waves.

9 Claims, 8 Drawing Figures

FIG. 1
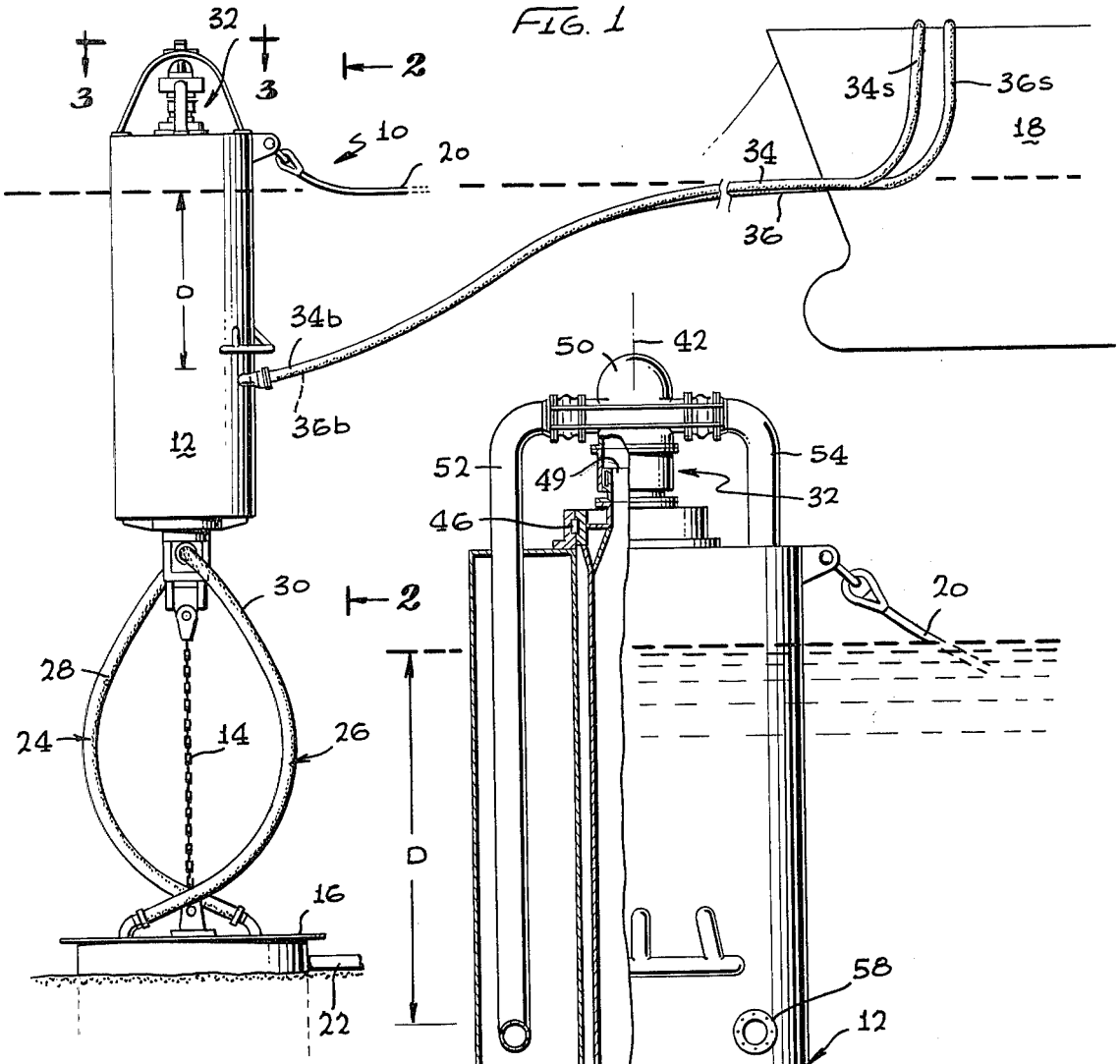
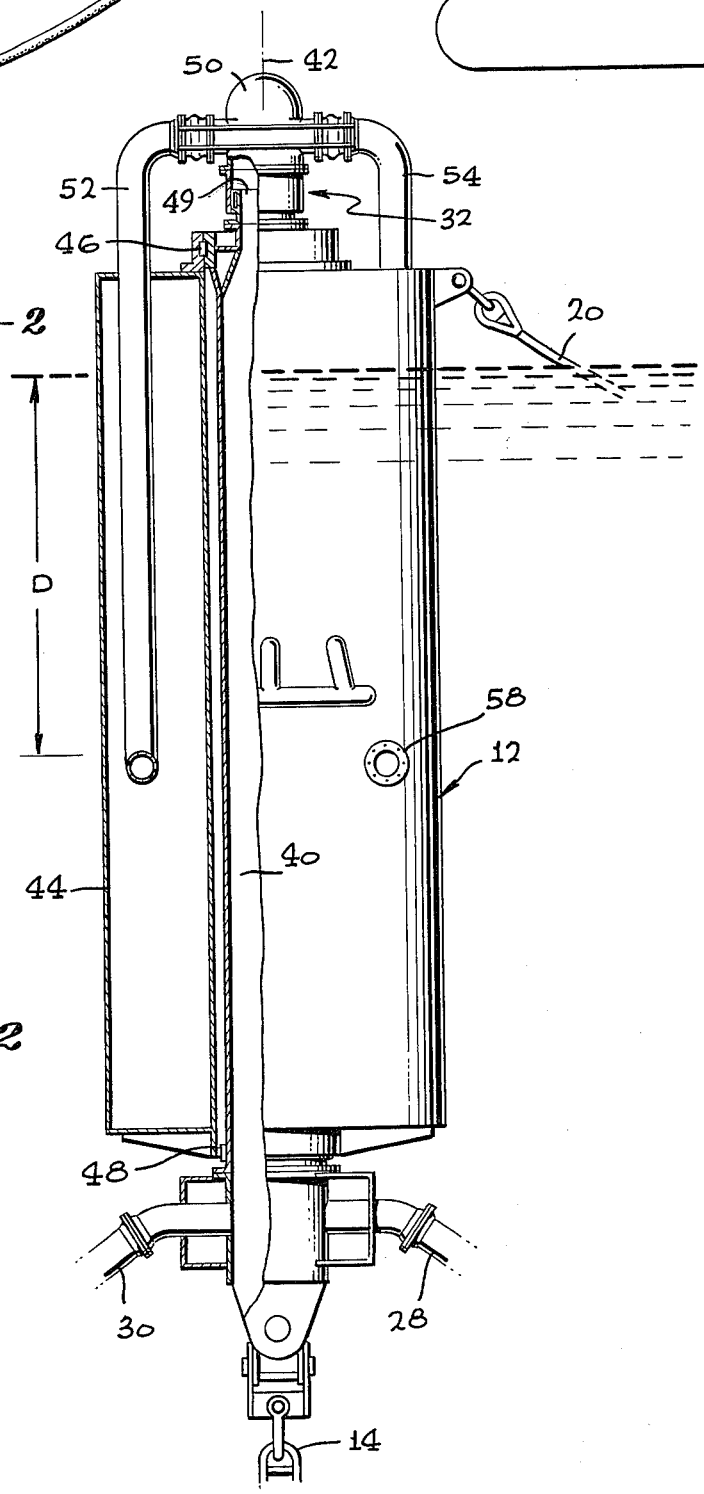
FIG. 2

FIG. 3
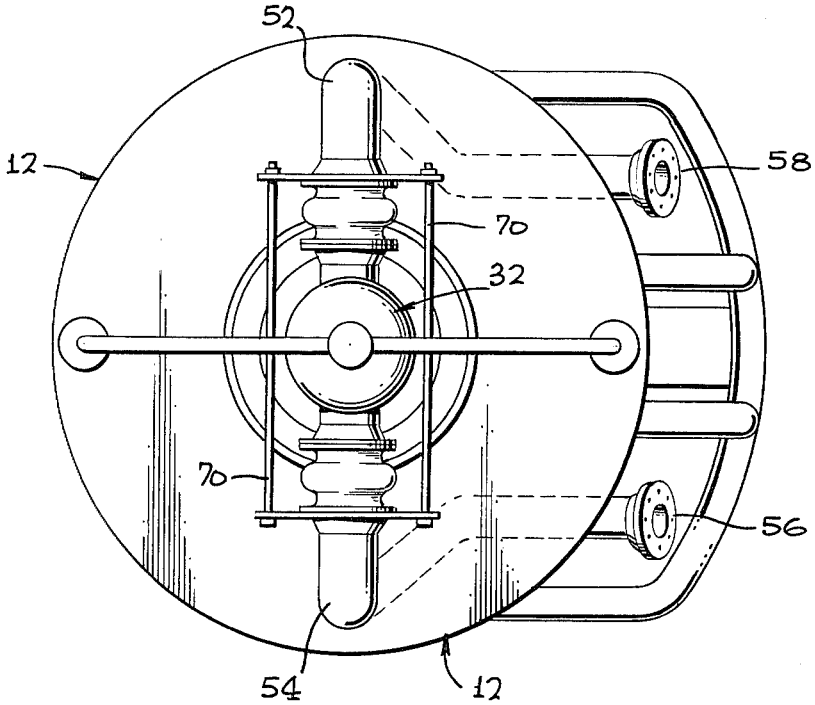
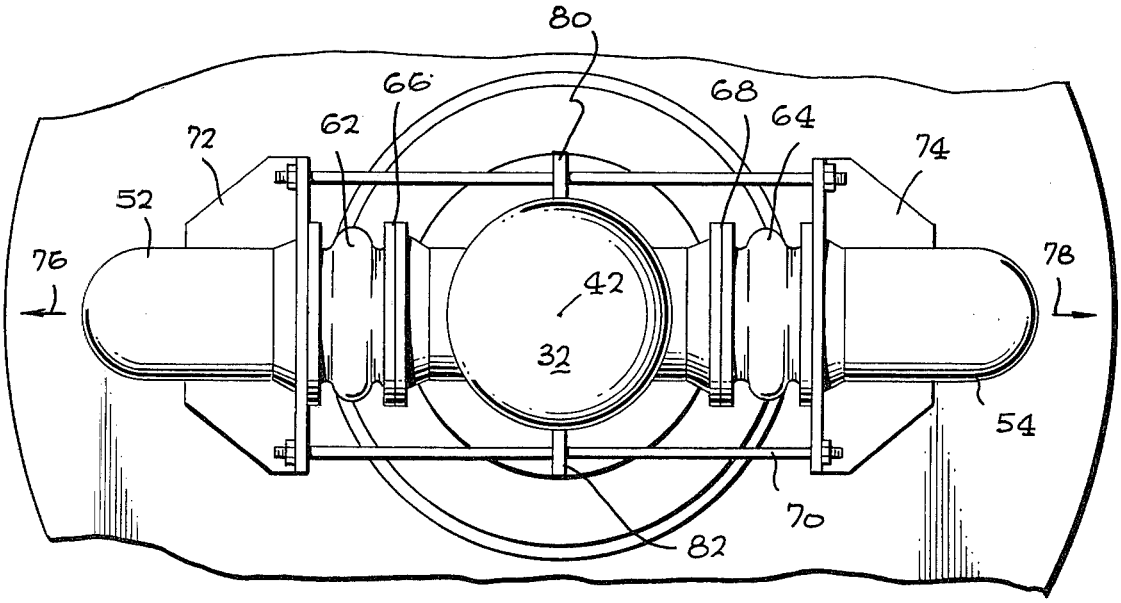
FIG. 4

MOORING TERMINAL WITH TOP MOUNTED FLUID SWIVEL

BACKGROUND OF THE INVENTION

A typical offshore terminal for mooring a ship while transferring oil or gas to or from the ship, includes a buoy connected by a hawser to the ship and a fluid conduit which is also connected to the ship. The ship must be permitted to drift about the buoy, so that a fluid swivel is required along the fluid conduit which connects a stationary pipeline at the seabed to the rotating vessel. A floating hose structure is often utilized to connect to the vessel, since this facilitates pickup of the hose structure and can minimize stresses on it.

In one type of terminal, commonly referred to as the CALM type (catenary anchor leg mooring), the buoy is anchored by several catenary chains to the seabed, and the buoy moves up and down with the tide and waves. The inner or buoy end of the floating hose structure is subjected to some wave action, but the effect is minimized by the fact that the inner end of the hose structure will move up and down as the buoy moves up and down in the waves.

In another type of terminal, commonly referred to as the SALM type (single anchor leg mooring), the buoy is anchored by a single leg or riser to the seabed, such as a column or single chain. The anchor leg is short enough that it is always held in tension by the buoy, and consequently, the buoy does not move up and down with the waves. If a fluid swivel were to lie at the top of such a buoy, and if the buoy end of a floating hose structure were to extend all the way to the fluid swivel or to a short pipe projecting therefrom, then the buoy end of the hose structure could be subjected to heavy pounding from wave action. That is, since the buoy does not move up and down with the waves, the upper portion of the buoy and any hoses connected thereat would be repeatedly uncovered and covered by the waves and subjected to pounding from the waves. To prevent wave damage, SALM (single anchor leg mooring) terminals typically utilize fluid swivels located below the buoy, such as at the sea base, so that the inner end of the floating hose structure is below the level of waves. However, this results in the fluid swivel being relatively inaccessible. A fluid swivel is considered a high maintenance item, in that leakage occasionally occurs and its seals then must be replaced. However, if the fluid swivel is located underwater, then the terminal usually must be dismantled to remove the fluid swivel for maintenance, which results in considerable cost. Also, if the anchor leg passes through the vertical axis of the rotation of the fluid swivel, then the anchor leg may have to be detached from the seabed base to remove the fluid swivel, unless somewhat costly bypassing mechanisms are resorted to.

OBJECTS AND SUMMARY OF THE INVENTION

An object of the present invention is to provide a single anchor leg mooring terminal (SALM) wherein the buoy cannot move up and down with the waves, which facilitates access to the fluid swivel for maintenance thereof without subjecting the buoy-end of the floating hose structure to pounding from waves.

In accordance with one embodiment of the present invention, an offshore mooring and cargo transfer terminal is provided, of the type which includes a buoy assembly anchored at a substantially fixed height above the seabed, which facilitates maintenance of a fluid swivel while protecting the buoy end of a ship-connecting hose structure from heavy wave action. The fluid swivel lies at the top of the buoy assembly, so it is out of the water for easy maintenance, and a downward fluid conduit is provided that extends from the rotatable portion of the fluid swivel and downwardly to an underwater depth which is below the trough of waves. The lower end of the downward conduit is connected to the hose structure, so that the hose structure lies below the troughs of the largest waves likely to be encountered.

In one terminal, a portion of the fluid conduit that extends from the sea base to the fluid swivel, passes through the center of the buoy, and the buoy and downward conduit that extend from the fluid swivel rotate together. The downward conduit extends through the buoy from the fluid swivel to an underwater depth, and its lower end emerges through the buoy to connect to the hose structure. In another terminal, the downward conduit extends on the outside of a nonrotatable buoy to the underwater level where it connects to the hose structure.

The novel features of the invention are set forth with particularity in the appended claims. The invention will be best understood from the following description when read in conjunction with the accompanying drawings.

BRIEF DESCRIPTION OF THE DRAWINGS

FIG. 1 is a side elevation view of an offshore terminal constructed in accordance with one embodiment of the present invention.

FIG. 2 is a partially sectional view taken on the line 2—2 of FIG. 1.

FIG. 3 is a view taken on the line 3—3 of FIG. 1.

FIG. 4 is a view of a portion of the terminal of FIG. 3.

DESCRIPTION OF THE PREFERRED EMBODIMENTS

Figure 5:
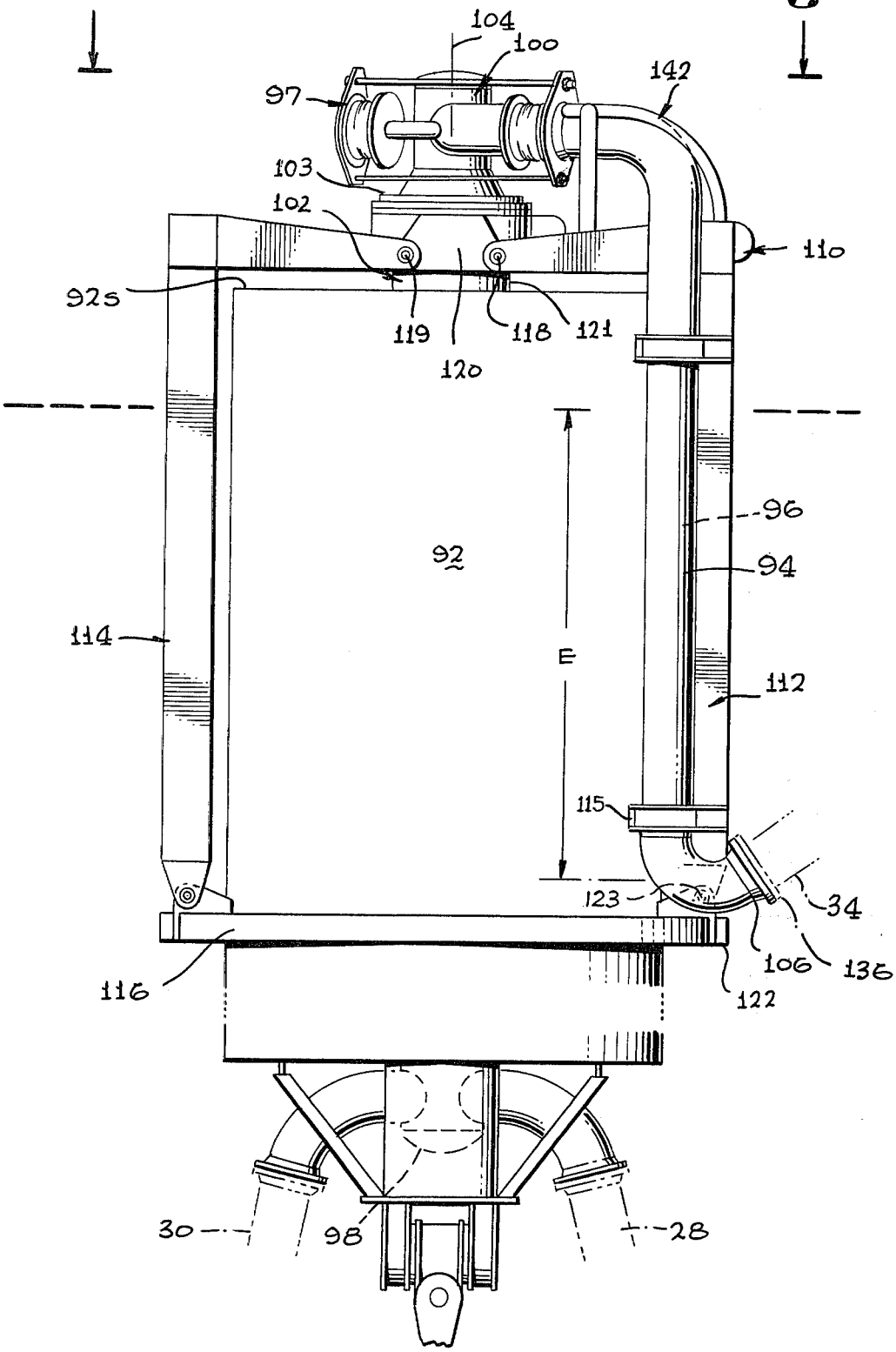
FIG. 5 is a side elevation view of a terminal constructed in accordance with another embodiment of the invention.
Figure 6:
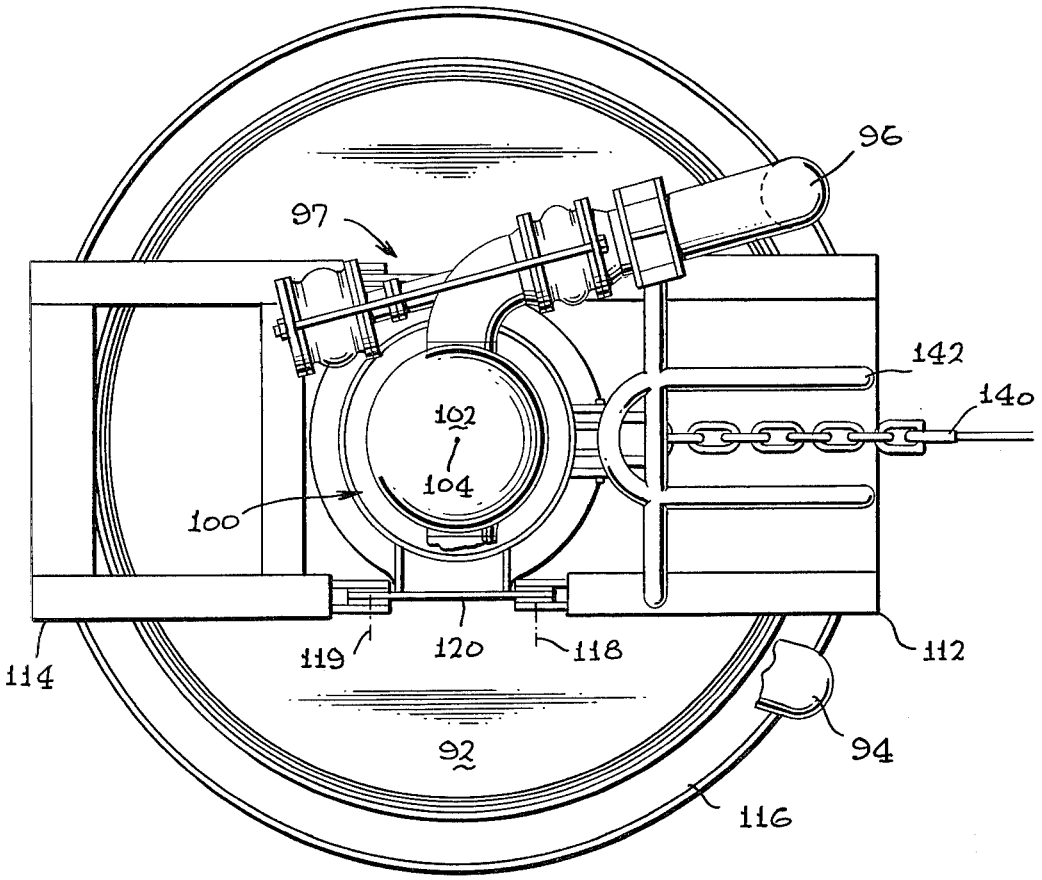
FIG. 6 is a partial view taken on the line 6—6 of FIG. 5.

FIG. 1 illustrates an offshore mooring and cargo transfer terminal 10 of the SALM type which includes a buoy assembly 12 held by a single anchor leg 14 in the form of a chain, to a base 16 at the sea floor. The anchor leg or riser 14 is short enough that it is always kept under tension by the buoy assembly 12, which allows the buoy assembly to exert considerable force on a ship 18 to hold the ship in position. As a consequence, the buoy assembly 12 does not rise and fall with waves and changes in tide levels. The ship 18 is moored by a hawser 20. A pair of pipe lines 22 at the sea floor, which may extend to oil wells or a shore base installation are connected through conduits 24, 26 to the ship. The conduits include underbuoy hoses 28, 30 extending from the seabed to the buoy assembly, a fluid swivel 32 on the buoy assembly, and a pair of flexible floating hose structures or hoses 34, 36 extending from the buoy assembly to the ship.

The fluid swivel 32 is located at the top of the buoy assembly at a level that is normally above water, which facilitates maintenance and disassembly thereof, since the swivel can be worked on without requiring divers. However, if the floating hoses 34, 36 were to extend from the level of the swivel 32, then they would be subjected to pounding from waves. Most of the length of the floating hoses can freely float on the water surface to ride up and down with waves, and in fact the ship ends 34*s*, 36*s* of the hoses will ride with the vessel on waves. (It may be noted that negatively buoyant hoses are sometimes used, with small buoys at their ship ends to facilitate pickup.) However, the buoy ends 34*b*, 36*b* of the hoses are prevented from moving up and down with the waves, and if they were exposed they would be subjected to pounding from the waves. To prevent this, the buoy ends of the floating hoses are located at a depth D below the average water level, or mean tide, where the depth is chosen so that the buoy ends of the hoses are substantially always under water, and are almost never exposed even in the troughs of large waves during low tide. The particular depth D depends, of course, upon the extremes of local conditions, so that a greater depth would be required in regions where there are large waves or large changes in mean tide level, than in regions where there are calmer seas and smaller changes in tide level. In most situations, a depth D of more than 2 meters (about 6 feet) below mean tide level is desirable.

As shown in FIG. 2, the buoy assembly includes a center column 40 extending along the axis of rotation 42 of the swivel unit, and a buoy 44 of annular shape which is rotatably mounted on the center column by a pair of bearing devices 46, 48. The center column 40 can rotate to some extent about the vertical axis 42, but cannot rotate without limit, and therefore it and the under buoy hoses 28, 30 may be considered to be stationary. The stationary portion 49 of the fluid swivel 32 is mounted at the top of the center column. The rotatable portion 50 of the fluid swivel can rotate without limit about the vertical axis 42. A pair of downward conduits 52, 54 extend from diametrically opposite sides of the rotatable fluid swivel portion 50. The conduits extend downwardly to the depth of the buoy ends of the floating hoses. Each downward conduit such as 52 extends through the inside of the annular buoy 44 to substantially the depth D below the average water level, and from there the conduit extends through the buoy 44 to a coupling 56, 58 that lies immediately outside the buoy 44. Thus, the annular buoy 44, with a relatively smooth cylindrical outer surface which is resistant to damage from waves, protects the downward conduits 52, 54 that extend from a level which is above most wave action to a level below the waves. The couplings 56, 58 connect to the buoy ends 34*b*, 36*b* of the floating hoses, so that the portion of each floating hose which cannot easily move up and down with the waves, is protected from pounding by the waves.

The uppermost bearing device 46 which rotatably supports the annular buoy 44 on the center column 40, is constructed as both a thrust and radial bearing to withstand both axial loads (along the direction of the axis 42) as well as radial loads. The lower bearing 48 is constructed as only a radial bearing to withstand only radial loads, so that slight axial shifting of the bottom of the center column 40 with respect to the bottom of the buoy 44 does not have to be avoided. It may be noted that two underbuoy hoses 28, 30 may be utilized that carry oil from the same well, to balance the loading on the buoy assembly, and in that case the center column 40 can be utilized as a single pipe. In those cases where the fluid in the two underbuoy hoses are to be separated, two separate pipes can extend along the center column 40, and a multiple product fluid swivel can be utilized at 32.

As shown in FIG. 4, the two downward conduits 52, 54 extend from diametrically opposite sides of the fluid swivel, so that the forces applied by them to the swivel are balanced. Such forces are applied because of the considerable pressure of oil or other fluid moving through the system, and the curve in the conduits. While the two downward conduits can balance the sideward forces on the fluid swivel 32, each downward conduit can apply a considerable force to the fluid swivel. Such forces are preferably avoided, since they can add loading to the seals of the fluid swivel which can cause them to leak. The forces that may be applied along most of the considerable length of each downward conduit, may be isolated from the fluid swivel by the use of flexible joints 62, 64 to connect the top part of each downward conduit to a corresponding coupling 66, 68 of the swivel. However, the flexible joints 62, 64 leave the upper end of each downward conduit unsupported. It would be possible to utilize a large brace to hold the top of each downward conduit securely to the top of the buoy 44, but this would add to the weight and expense of the terminal. Instead, a group of four tie rods 70 are utilized to connect the upper portions of the two downward conduits 52, 54 together, in a manner that largely bypasses the fluid swivel 32.

As shown in FIG. 4, the tie rods 70 are fastened to a pair of brackets 72, 74 that are each attached to a different one of the downward conduits 52, 54 at a side of the respective flexible joints that lie opposite the fluid swivel. Large forces in the direction of arrows 76, 78 are applied to the upper ends of the conduits 52, 54 due to the elbows formed therein that cause high pressure fluid to change direction by 90°. The tie rods 70 enable the connection of the upper ends of the two downward conduits 54, 56 so that the forces in the direction 76, 78 cancel one another, and this transmission of forces is accomplished without passing the forces through the fluid swivel 32. By transmitting primarily tension forces, a relatively simple structure can be utilized to transfer large forces, since relatively small rods can transmit very large forces if the forces are primarily in tension. Some relatively small forces perpendicular to the directions of the arrows 76, 78 may be encountered, and a pair of guides 80, 82 are provided on either side of the swivel to slidably guide the tie rods 70 in slight movement along the direction of arrow 76, 78. It may be noted that instead of utilizing only two downward conduits, three or more may be utilized, with each having a flexible joint, and with the downward conduit portions connected together at location on the sides of the flexible joints opposite the fluid swivel.

FIGS. 5–8 illustrate a mooring and cargo transfer terminal which is also of the single anchor leg mooring type, but wherein the buoy assembly is constructed with a buoy 92 which does not rotate without limit about a vertical axis, and wherein a pair of downward conduits 94, 96 are utilized which extend on the outside of the buoy 92. It may be noted that each conduit is provided with a force balancing device 97 that is commercially available. The terminal includes a pair of underbuoy hoses 28, 30 which connect to a central conduit portion or pipe 98 that is fixed to the buoy 92 and that extends upwardly along the center of the buoy to a swivel unit 100 mounted at the top of the buoy. The stationary portion 102 of the swivel unit is mounted on the buoy, while the rotatable portion 103 which rotates about a vertical axis 104 is connected to the downward conduits 94, 96. The lower ends 106, 108 of the downward conduits are supported in rotation about the buoy, at an underwater depth E which is chosen to avoid uncovering of floating hoses such as 34 connected thereto, in the troughs of waves at low tide, as described earlier herein.

In order to avoid excessive loading of the downward conduits 94, 96 and of the fluid swivel 100 to which they connect, a conduit support structure 110 is provided that is rotatably supported on the buoy 92 and that supports the downward conduits 94, 96. The support structure 110 includes two arms 112, 114 extending along opposite sides of the buoy, and a bearing ring 116 connected to the lower ends of the arms. The upper end of each arm such as 112 is pivotally connected about horizontal axes 118, 119 to an upper bracket 120 at the top of the buoy. The upper bracket 120 is mounted on a bearing 121 which surrounds the swivel unit 100, and which independently rotates about the vertical axis 104. The lower end of each arm is pivotally connected, as at axis 123, to lower brackets fixed to the bearing ring 116.

Figure 8:
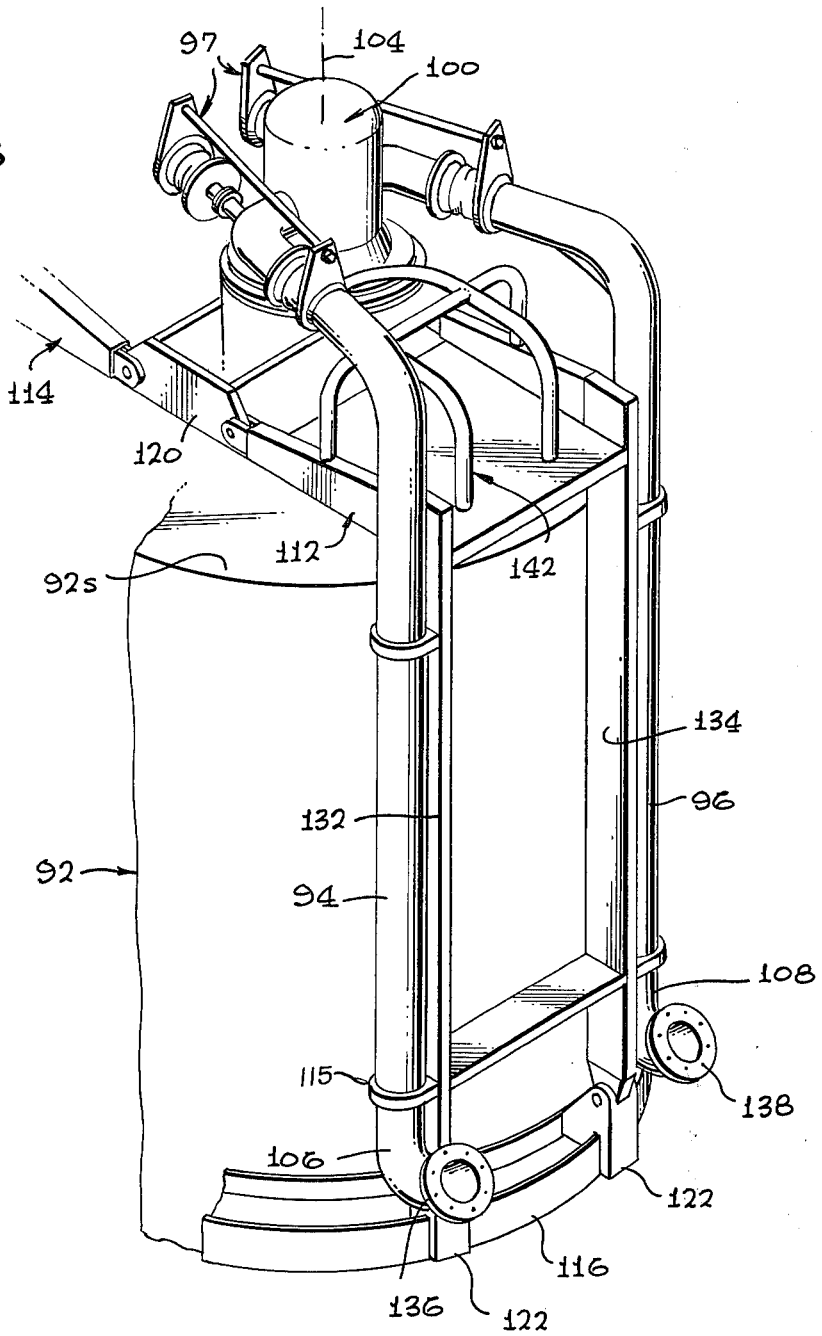
FIG. 8 is a partial perspective view of the terminal of FIG. 5.
Figure 7:
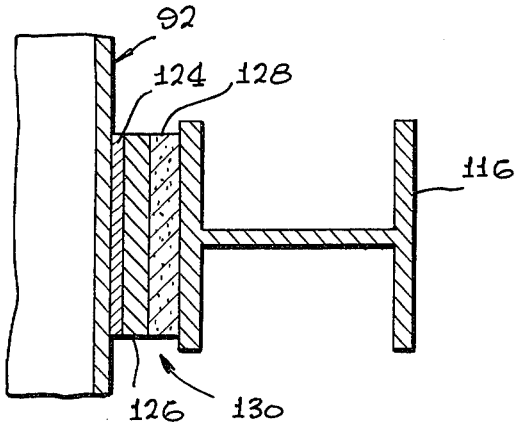
FIG. 7 is a sectional view of a portion of the terminal of FIG. 5.

As shown in FIG. 8, the lower end of each arm such as 112, is pivotally connected to the bearing ring 116 by lower brackets 122 that are fixed to the ring. One of the arms 112 serves to support the weight of the downward conduits 94, 96, so that the conduit weight is not supported on the swivel unit 100. The arm 112 also supports the downward conduits 94, 96 against excessive bending. This is accomplished by holding each conduit to the arm by a pipe-holding bracket 115 which lies at an underwater depth which is at least one-half the depth E at the buoy end of the hoses. The other arm 114 serves to support a side of the bearing ring 116 which is opposite to the side which is supported by the arm 112 and to compensate for the weight of the arm 112 and the conduits thereon. As shown in FIG. 7, the ring 116 is formed by a curved I-beam. A chock 124 fastened to the outside of the buoy 94, supports a backup plate 126 which, in turn, supports an aluminum-bronze composition sliding bearing ring 128. The outside bearing ring 116 slides along the inside bearing 128. The bearing assembly 130 formed by the outside and inside bearings 116, 128 form a radial bearing, with the weight of the arm 112 and downward conduit thereon supported by the bracket 120 at the top of the buoy.

The pivotal mounting of the top and bottom of each arm such as 112, results in minimal bending load on its ends, so that a relatively light weight arm can be utilized. It can be seen that the arm has a considerable width between its opposite sides at 132, 134, which enables it to transmit appreciable moments tending to turn the arm and fluid swivel 100 about the vertical axis of rotation 104. Part of the turning forces may be applied by the floating hoses connected to couplings 136, 138 at the lower ends 106, 108 of the downward conduits, while additional turning forces may be applied by a hawser 140 which may apply sideward forces to a guard 142 mounted on the arm 112. The terminal of FIGS. 5–8 utilizes a relatively small apparatus on the buoy 92 that must rotate with the ship, so that only a moderate force is required to rotate the fluid swivel and downward conduits.

The terminal of FIGS. 5–8 can be modified in several ways. Instead of using the compensating arm 114, a weight can be mounted on the upper bracket 120. Then, instead of using the bearing ring 116, a circular slipper bar can be mounted on the buoy and the brackets 122 can be allowed to slide on the slipper bar. Also, instead of connecting the lower end such as 106 of a downward conduit, to a hose, another fluid swivel can be connected at 106 with its pivot axis horizontal, to permit the terminal end of the hose 34 to easily pivot so as to minimize strain on it. Such a fluid swivel could, of course, be relatively easily removed for maintenance.

In one terminal designed for use near the Cayman Islands, the buoy 92 (FIG. 5) had a diameter of 18 feet and height of 48 feet, and the downward conduits such as 94 had a diameter of 2 feet. The buoy was designed for installation so its upper surface 92*s* was six feet above the mean tide level. The bearing ring 116 was installed 28 feet below the upper surface of the buoy, or in other words, 22 feet below mean tide. The couplings such as 136 therefore were at an underwater depth of about 18 feet, and the bracket 115 was at an underwater depth of about 16 feet.

Thus, the invention provides a mooring and cargo transfer terminal of the type wherein a buoy is held at a substantially fixed height about the seabed so that it cannot move up and down with the waves, wherein the floating hoses which must extend to the ship and rotate with it are protected from wave pounding and yet the fluid swivel which permits rotation of the floating hoses is easily accessible for maintenance. This is accomplished by locating the fluid swivel above the water line and utilizing a downward conduit to extend from the rotatable portion of the fluid swivel through the water line and to an underwater depth which is below the troughs of the maximum waves that are encountered in the region of the terminal at low tide. The downward conduit is preferably supported on the buoy at an underwater depth of at least one-half the depth of the lower end of the downward conduit. In one terminal, the buoy is of annular form and rotates about a vertical axis, and the downward conduit can extend through the buoy so that it emerges at an underwater depth to connect to the buoy end of an underwater hose thereat. In another terminal, the buoy is stationary and the downward conduit extends around the outside of the buoy to the underwater depth which is below wave action. Where the downward conduit lies on the outside of the buoy it can be supported by an arm pivotally connected at its upper end to a bearing which rotates at the top of the buoy, and pivotally connected at its lower end to a radial bearing ring which encircles the buoy at an underwater depth.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. A buoy system comprising:

a buoy with top and bottom portions;

an upper bracket rotatably mounted to the top portion of the buoy to rotate about a substantially vertical axis thereon;

a fluid swivel mounted at the top portion of the buoy, and having a rotatable portion which is rotatable about said vertical axis;

a fluid conduit extending from said rotatable portion of the fluid swivel and downwardly on the outside of said buoy;

a ring bearing mounted on said buoy at a location below said upper bracket and fluid swivel, said ring bearing extending about said buoy in a circle substantially centered on said vertical axis;

an arm having an upper end pivotally connected to said upper bracket and a lower end pivotally coupled to said ring bearing to pivot about a substantially horizontal axis, and rotate about the buoy; and means connecting the lower portion of said fluid conduit to said arm, to enable the arm to help support the fluid conduit.

2. The buoy system described in claim 1 wherein:

said ring bearing comprises a ring which can rotate about said buoy and which is free to move vertically with respect to said buoy, and said system includes a plurality of arms supporting the weight of said ring including said first mentioned arm and at least one additional arm which has an upper end pivotally mounted on said upper bracket and a lower end pivotally coupled to said ring bearing.

3. The buoy system described in claim 1 including:

a single anchor leg extending between a sea bottom and said buoy, said leg holding said buoy submerged at a greater depth than the buoy would float at if not held by the leg; and a floating hose structure connected to the lower end portion of said fluid conduit;

said fluid conduit extends to an underwater depth of more than two meters at mean tide level, whereby to help safeguard said floating hose structure from the effects of waves.

4. A fluid swivel assembly for use in a mooring and cargo transfer system of the type which includes a buoy anchored to the sea floor and a fluid conduit means extending from the sea floor and through the fluid swivel for connection to a vessel, comprising:

a fluid swivel having a stationary portion and a rotatable portion which is rotatable without limit about a vertical axis;

a pair of fluid conduits extending in opposite directions from said fluid swivel, each conduit including an expandable section that permits the conduit to expand and contract in length; and tying means connecting together locations on said pair of fluid conduits lying beyond the ends of said expandable sections, which are furthest from said fluid swivel, said tying means being free to move relative to said fluid swivel to support each conduit on the other against excessive deflection away from the axis of rotation of the fluid swivel.

5. An offshore mooring and cargo transfer terminal, comprising:

a mooring base mounted at the sea bottom;

a buoy assembly floating at the sea surface;

an anchor leg connecting said base to said buoy assembly to hold the buoy assembly in approximate location;

an underbuoy fluid conduit extending from substantially the depth of said base to said buoy assembly; hawser means extending from said buoy assembly, for mooring a vessel; and a flexible hose assembly extending from said buoy assembly, for connection to a vessel;

said buoy assembly including a buoy, and a fluid swivel with a stationary portion and with a rotatable portion rotatable about a largely vertical axis, said swivel located substantially at the top of the buoy to facilitate maintenance thereof, said buoy assembly also having a first buoy conduit extending up from the upper end of said underbuoy conduit to the stationary portion of the fluid swivel, and a second conduit extending down from the rotatable portion of the fluid swivel to a location on the buoy which is lower than the fluid swivel;

said anchor leg being short enough so it is held substantially continuously in tension by said buoy assembly in sea waves, said second conduit extending to an underwater level on the buoy which is below the level of waves and securely held at an underwater location to said buoy, and said second conduit connected thereat to said hose assembly, whereby to safeguard the buoy end of the flexible hose assembly from wave action;

said buoy assembly including a pair of second conduits, including said previously mentioned second conduit, extending from opposite sides of said fluid swivel, each of said second conduits including a substantially horizontal expansion section; and said buoy assembly also including a plurality of tension members connecting together locations on said pair of second conduits which lie beyond each of said expansion sections, said tension members being free to move relative to said fluid swivel.

6. In an offshore mooring and cargo transfer terminal of a type which includes a buoy assembly anchored to lie at a predetermined height above the seabed and having a hawser-holding portion rotatable without limit about a vertical axis and which is connectable by a hawser to a ship to moor it, and wherein the terminal also includes a fluid conduit extending from the seabed and having a fluid swivel rotatable about a vertical axis and a flexible floating hose structure with an inner end which must be coupled to the rotatable portion of the fluid swivel, and wherein the hose structure must extend from an underwater depth below wave action, and more than about 2 meters below the water surface, at an incline up to the sea surface to connect to the moored ship, the improvement wherein:

said fluid swivel lies at the top of said buoy assembly, and said fluid conduit includes two downward conduit portions extending from diametrically opposite sides of the rotatable portion of the swivel, at least one of said downward conduit portions extending downwardly to the depth of the buoy end of said flexible floating hose structure, with the lower end of said downward conduit portion lying at a depth of at least about 2 meters below average water level;

each downward conduit portion including an expansion joint at substantially the level of said fluid swivel; and including a plurality of tie rod members connecting together locations on said downward conduit portions lying beyond the ends of said expansion joints but being free to move relative to said rotatable fluid swivel portion to support each downward conduit portion on the other against excessive deflection away from the axis of rotation of the fluid swivel.

7. In an offshore mooring and cargo transfer terminal of a type which includes a buoy assembly anchored to lie at a predetermined height above the seabed and having a hawser-holding portion rotatable without limit about a vertical axis and which is connectable by a hawser to a ship to moor it, and wherein the terminal also includes a fluid conduit extending from the seabed and having a fluid swivel rotatable about a vertical axis and a flexible floating hose structure with an inner end which must be coupled to the rotatable portion of the fluid swivel, and wherein the hose structure must extend from an underwater depth below wave action, and more than about 2 meters below the water surface, at an incline up to the sea surfaces to connect to the moored ship, the improvement wherein:

said fluid swivel lies at the top of said buoy assembly, and said fluid conduit includes a downward conduit portion extending from the rotatable portion of the fluid swivel and downwardly to the depth of the buoy end of said flexible floating hose structure, with the lower end of said downward conduit portion lying at a depth of at least about 2 meters below average water level; and including a bearing ring lying underwater and rotatable on said buoy about said vertical axis;

an upper bracket rotatably mounted on the top of said buoy about said vertical axis;

a plurality of arms having upper ends pivotally connected to said upper bracket and lower ends pivotally coupled to said bearing ring; and at least one underwater pipe-holding bracket connecting one of said arms to said fluid conduit.

8. A fluid swivel assembly for use in a mooring and cargo transfer system of the type which includes a buoy anchored to the sea floor and a fluid conduit means extending from the sea floor and through the fluid swivel for connection to a vessel, comprising:

a fluid swivel having a stationary portion and a rotatable portion which is rotatable without limit about a vertical axis;

a pair of fluid conduits extending in opposite directions from said rotatable portion of said fluids swivel, each conduit including an expandable section that permits the conduit to expand and contract in length; and tying means connecting together locations on said pair of fluid conduits lying beyond the ends of said expandable sections which are furthest from said fluid swivel, to support each conduit on the other against excessive deflection away from the axis of rotation of the fluid swivel;

said tying means comprises a plurality of tie rod members which are free to move relative to said fluid swivel and said buoy, to allow said conduit locations to move in directions towards one another without corresponding movement of said fluid swivel.

9. A fluid swivel assembly for use in a mooring and cargo transfer system of the type which includes a buoy anchored to the sea floor and a fluid conduit means extending from the sea floor and through the fluid swivel for connection to a vessel, comprising:

a fluid swivel having a stationary portion and a rotatable portion which is rotatable without limit about a vertical axis;

a pair of fluid conduits extending in opposite directions from said rotatable portion of said fluid swivel, each conduit including an expandable section that permits the conduit to expand and contract in length; and tying means connecting together locations on said pair of fluid conduits lying beyond the ends of said expandable sections which are furthest from said fluid swivel, to support each conduit on the other against excessive deflection away from the axis of rotation of the fluid swivel;

said tying means includes a plurality of tension members spaced substantially symmetrically about the axis of said pair of fluid conduits.

* * * * *